US011749891B2

(12) United States Patent
Li et al.

(10) Patent No.: US 11,749,891 B2
(45) Date of Patent: Sep. 5, 2023

(54) ANTENNA STRUCTURE

(71) Applicant: Wistron NeWeb Corp., Hsinchu (TW)

(72) Inventors: Jian-De Li, Hsinchu (TW); Cheng-Da Yang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 58 days.

(21) Appl. No.: 17/404,023

(22) Filed: Aug. 17, 2021

(65) Prior Publication Data

US 2023/0028988 A1 Jan. 26, 2023

(30) Foreign Application Priority Data

Jul. 23, 2021 (TW) ..... 110127094

(51) Int. Cl.
*H01Q 1/24* (2006.01)
*H01Q 5/328* (2015.01)
*H01Q 1/38* (2006.01)

(52) U.S. Cl.
CPC ..... *H01Q 5/328* (2015.01); *H01Q 1/24* (2013.01); *H01Q 1/38* (2013.01)

(58) Field of Classification Search
CPC ..... H01Q 5/328; H01Q 1/24–50; H01Q 1/243
See application file for complete search history.

(56) References Cited

U.S. PATENT DOCUMENTS

| | | | | |
|---|---|---|---|---|
| 7,602,341 | B2 | 10/2009 | Wei-Shan et al. | |
| 9,484,631 | B1 * | 11/2016 | Napoles | H01Q 5/378 |
| 2012/0146865 | A1 * | 6/2012 | Hayashi | H01Q 5/392 343/750 |
| 2013/0241800 | A1 * | 9/2013 | Schlub | H01Q 21/29 343/893 |
| 2015/0222020 | A1 * | 8/2015 | Tai | H01Q 9/42 343/745 |

FOREIGN PATENT DOCUMENTS

CN 102956959 A * 3/2013

* cited by examiner

*Primary Examiner* — Henry Luong
(74) *Attorney, Agent, or Firm* — McClure, Qualey & Rodack, LLP

(57) ABSTRACT

An antenna structure includes a feeding radiation element, a first radiation element, a second radiation element, a shorting element, a first tuner, and a second tuner. The feeding radiation element has a feeding point. The first radiation element is coupled to the feeding radiation element. The first radiation element is coupled through the first tuner to a ground voltage. The feeding radiation element is coupled through the shorting element to the ground voltage. The second radiation element is adjacent to the first radiation element, and is separated from the first radiation element. The second radiation element is coupled through the second tuner to the ground voltage. The feeding radiation element is disposed between the first tuner and the shorting element.

17 Claims, 5 Drawing Sheets

ANTENNA STRUCTURE

CROSS REFERENCE TO RELATED APPLICATIONS

This application claims priority of Taiwan Patent Application No. 110127094 filed on Jul. 23, 2021, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

BRIEF SUMMARY OF THE INVENTION

In an exemplary embodiment, the invention is directed to an antenna structure that includes a feeding radiation element, a first radiation element, a second radiation element, a shorting element, a first tuner, and a second tuner. The feeding radiation element has a feeding point. The first radiation element is coupled to the feeding radiation element. The first radiation element is coupled through the first tuner to a ground voltage. The feeding radiation element is coupled through the shorting element to the ground voltage. The second radiation element is adjacent to the first radiation element, and is separated from the first radiation element. The second radiation element is coupled through the second tuner to the ground voltage. The feeding radiation element is disposed between the first tuner and the shorting element.

In some embodiments, the feeding radiation element substantially has a relatively short straight-line shape. The first radiation element substantially has a relatively long straight-line shape. The first radiation element is substantially perpendicular to the feeding radiation element.

In some embodiments, the shorting element substantially has an L-shape.

In some embodiments, the second radiation element substantially has a straight-line shape.

In some embodiments, a coupling gap is formed between the second radiation element and the first radiation element. The width of the coupling gap is from 0.5 mm to 2 mm.

In some embodiments, the antenna structure covers a first frequency band from 600 MHz to 960 MHz.

In some embodiments, the total length of the feeding radiation element and the first radiation element is from 0.25 to 0.5 wavelength of the first frequency band.

In some embodiments, the length of the second radiation element is from 0.125 to 0.25 wavelength of the first frequency band.

In some embodiments, the first tuner is coupled to a first connection point on the first radiation element. The path length between the feeding point and the first connection point is from 0.125 to 0.25 wavelength of the first frequency band.

In some embodiments, the first tuner includes a first variable capacitor and a first switch element which are coupled in series.

In some embodiments, the capacitance of the first variable capacitor is from 0.7 pF to 8 pF. The first switch element is selectively closed or opened.

In some embodiments, the second tuner includes a second variable capacitor and a second switch element which are coupled in series.

In some embodiments, the capacitance of the second variable capacitor is from 0.7 pF to 8 pF. The second switch element is selectively closed or opened.

In some embodiments, the antenna structure further includes a third radiation element coupled to the feeding radiation element. The third radiation element and the first radiation element substantially extend in opposite directions.

In some embodiments, the antenna structure further includes a fourth radiation element coupled to the ground voltage. The fourth radiation element is adjacent to the feeding point.

In some embodiments, the antenna structure further includes a fifth radiation element coupled to the shorting element. The fifth radiation element is disposed between the third radiation element and the shorting element.

In some embodiments, the antenna structure further covers a second frequency band, a third frequency band, and a fourth frequency band. The second frequency band is from 1575 MHz to 2690 MHz. The third frequency band is from 3200 MHz to 4200 MHz. The fourth frequency band is from 5150 MHz to 5925 MHz.

In some embodiments, the total length of the feeding radiation element and the third radiation element is from 0.25 to 0.5 wavelength of the second frequency band.

In some embodiments, the length of the fourth radiation element is from 0.5 to 1 wavelength of the third frequency band.

In some embodiments, the distance between the fourth radiation element and the feeding point is from 0.125 to 0.25 wavelength of the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
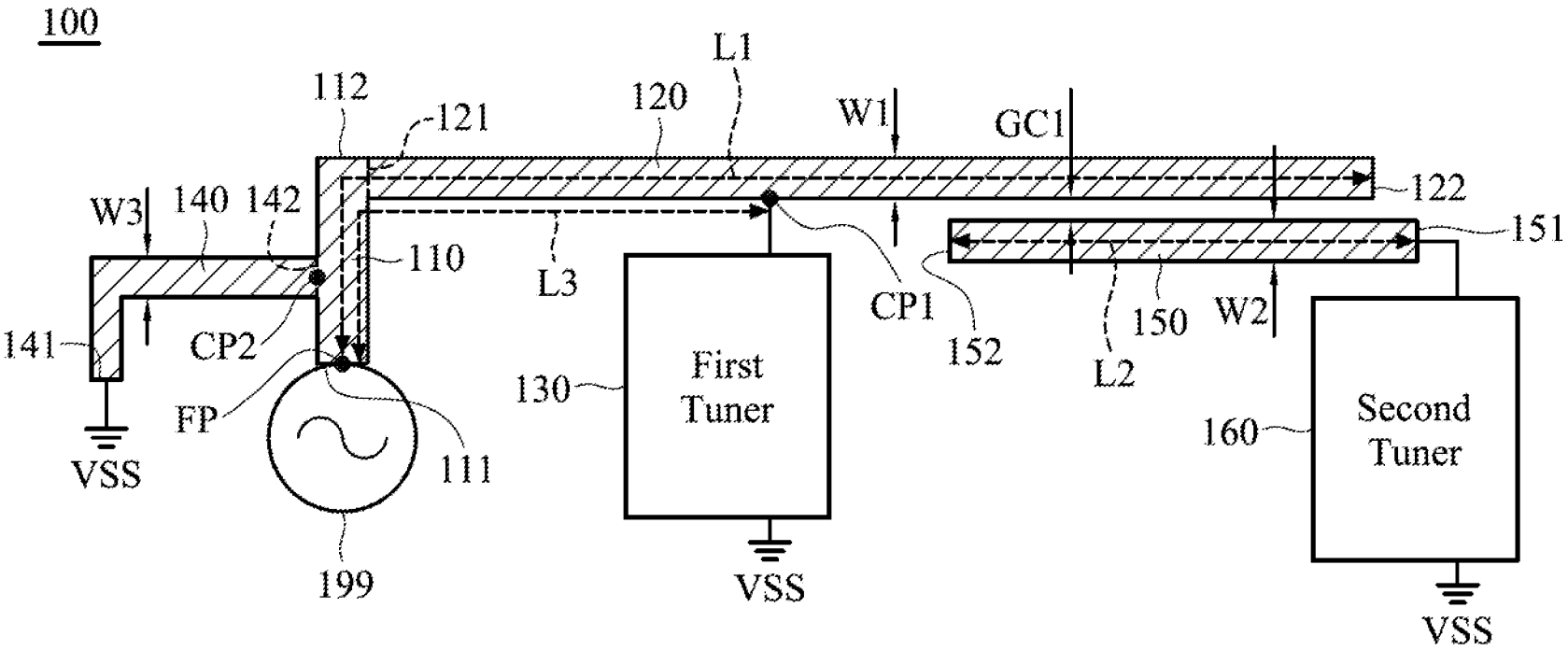
FIG. 1 is a diagram of an antenna structure according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of an antenna structure 100 according to an embodiment of the invention. The antenna structure 100 may be applied to a mobile device, such as a smart phone, a tablet computer, or a notebook computer. In the embodiment of FIG. 1, the antenna structure 100 at least includes a feeding radiation element 110, a first radiation element 120, a first tuner 130, a shorting element 140, a second radiation element 150, and a second tuner 160. The feeding radiation element 110, the first radiation element 120, the shorting element 140, and the second radiation element 150 may all be made of metal materials, such as copper, silver, aluminum, iron, or their alloys.

The feeding radiation element 110 may substantially have a relatively short straight-line shape. Specifically, the feeding radiation element 110 has a first end 111 and a second end 112. A feeding point FP is positioned at the first end 111 of the feeding radiation element 110. The feeding point FP may be further coupled to a signal source 199, such as an RF (Radio Frequency) module, for exciting the antenna structure 100.

The first radiation element 120 may substantially have a relatively long straight-line shape. The first radiation element 120 may be substantially perpendicular to the feeding radiation element 110. Specifically, the first radiation element 120 has a first end 121 and a second end 122. The first end 121 of the first radiation element 120 is coupled to the second end 112 of the feeding radiation element 110. The second end 122 of the first radiation element 120 is an open end. However, the invention is not limited thereto. In alternative embodiments, an angle between the first radiation element 120 and the feeding radiation element 110 is from 45 to 135 degrees, e.g., about 70, 80, 90, 100, or 110 degrees.

The first tuner 130 provides a first tunable impedance value. The first tuner 130 is coupled to a first connection point CP1 on the first radiation element 120. In addition, the first radiation element 120 is coupled through the first tuner 130 to a ground voltage VSS. For example, the ground voltage VSS may be provided by a ground copper foil, which may be further coupled to a system ground plane (not shown). It should be noted that the feeding radiation element 110 is disposed between the first tuner 130 and the shorting element 140. For example, the first tuner 130 may be positioned at the right side of the feeding radiation element 110, and the shorting element 140 may be positioned at the left side of the feeding radiation element 110, but they are not limited thereto.

The shorting element 140 may substantially have an L-shape. Specifically, the shorting element 140 has a first end 141 and a second end 142. The first end 141 of the shorting element 140 is coupled to the ground voltage VSS. The second end 142 of the shorting element 140 is coupled to a second connection point CP2 on the feeding radiation element 110. That is, the feeding radiation element 110 is coupled through the shorting element 140 to the ground voltage VSS.

The second radiation element 150 may substantially have a straight-line shape. The second radiation element 150 is disposed adjacent to the first radiation element 120, and is completely separated from the first radiation element 120. It should be noted that the term "adjacent" or "close" over the disclosure means that the distance (spacing) between two corresponding elements is smaller than a predetermined distance (e.g., 5 mm or the shorter), but often does not mean that the two corresponding elements directly touch each other (i.e., the aforementioned distance/spacing between them is reduced to 0). Specifically, the second radiation element 150 has a first end 151 and a second end 152. The second end 152 of the second radiation element 150 is an open end. For example, the second end 152 of the second radiation element 150 and the second end 122 of the first radiation element 120 may extend in opposite directions and away from each other. In some embodiments, the second radiation element 150 is substantially parallel to the first radiation element 120, and a coupling gap GC1 is formed between the second radiation element 150 and the first radiation element 120.

In alternative embodiments, the specific shape of each of the feeding radiation element 110, the first radiation element 120, the shorting element 140, and the second radiation element 150 is adjustable according to different requirements. For example, any of the feeding radiation element 110, the first radiation element 120, the shorting element 140, and the second radiation element 150 may substantially have a variable-width straight-line shape, an L-shape, a T-shape, a U-shape, or a meandering shape, but it is not limited thereto.

The second tuner 160 provides a second tunable impedance value. The second tuner 160 is coupled to the first end 151 of the second radiation element 150. In addition, the second radiation element 150 is coupled through the second tuner 160 to the ground voltage VSS. It should be understood that by using the first tuner 130 and the second tuner 160 for impedance adjustments, the antenna structure 100 can cover the desired wideband operation without increasing additional design area.

In some embodiments, the antenna structure 100 is formed on a dielectric substrate (not shown). For example, the dielectric substrate may be a PCB (Printed Circuit Board) or an FPC (Flexible Printed Circuit). The antenna structure 100 may be a planar structure, but the invention is not limited thereto. In alternative embodiments, the antenna structure 100 is a 3D (Three-Dimensional) structure formed on any support element by using LDS (Laser Direct Structuring) technology.

Figure 2:
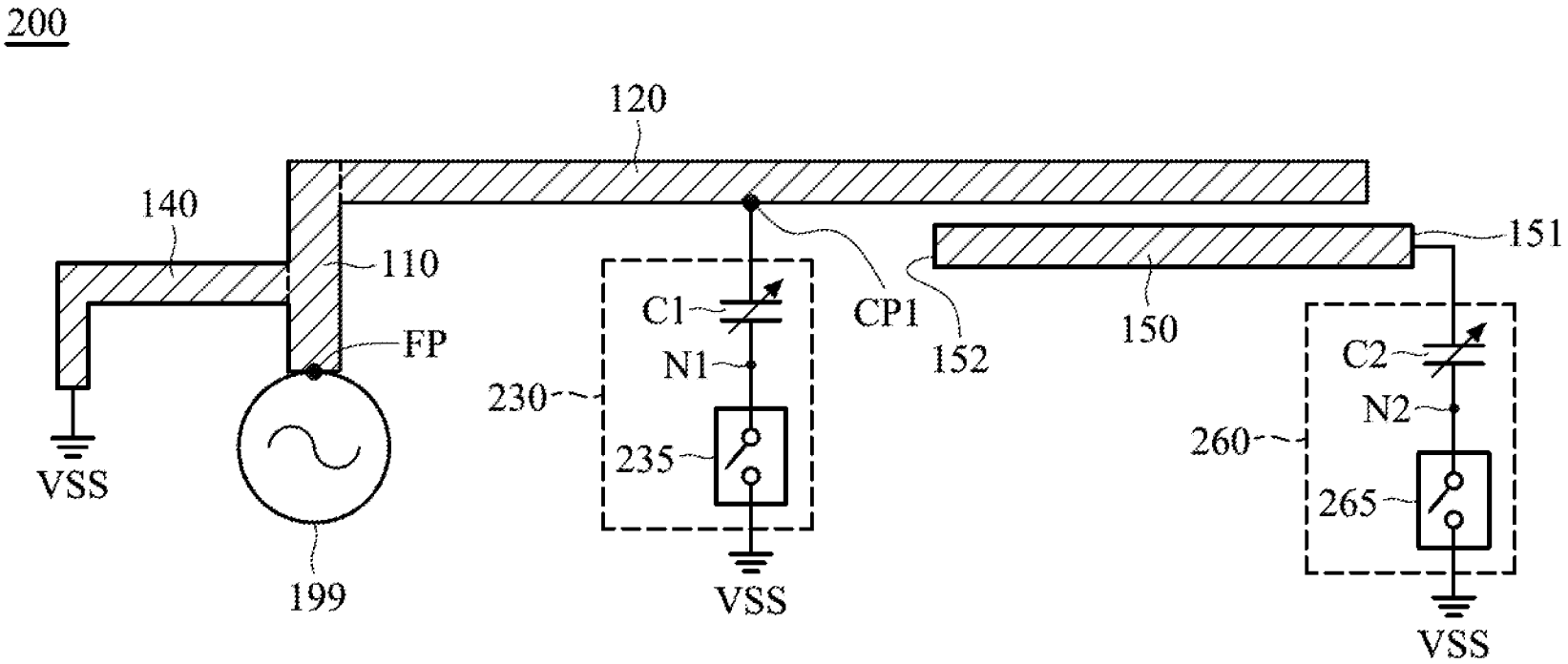
FIG. 2 is a diagram of an antenna structure according to an embodiment of the invention.

FIG. 2 is a diagram of an antenna structure 200 according to an embodiment of the invention. FIG. 2 is similar to FIG. 1. In the embodiment of FIG. 2, a first tuner 230 of the antenna structure 200 includes a first variable capacitor C1 and a first switch element 235 which are coupled in series, and a second tuner 260 of the antenna structure 200 includes a second variable capacitor C2 and a second switch element 265 which are coupled in series. Specifically, the first capacitor C1 has a first terminal coupled to the first connection point CP1, and a second terminal coupled to a first node N1. The first switch element 235 has a first terminal coupled to the first node N1, and a second terminal coupled to the ground voltage VSS. The first switch element 235 is selectively closed or opened. The second capacitor C2 has a first terminal coupled to the first end 151 of the second radiation element 150, and a second terminal coupled to a second node N2. The second switch element 265 has a first terminal coupled to the second node N2, and a second terminal coupled to the ground voltage VSS. The second switch element 265 is selectively closed or opened. In some embodiments, the first variable capacitor C1, the second variable capacitor C2, the first switch element 235, and the second switch element 265 are operated according to a control signal from a processor (not shown). Other features of the antenna structure 200 of FIG. 2 are similar to those of the antenna structure 100 of FIG. 1. Accordingly, the two embodiments can achieve similar levels of performance.

Figure 3:
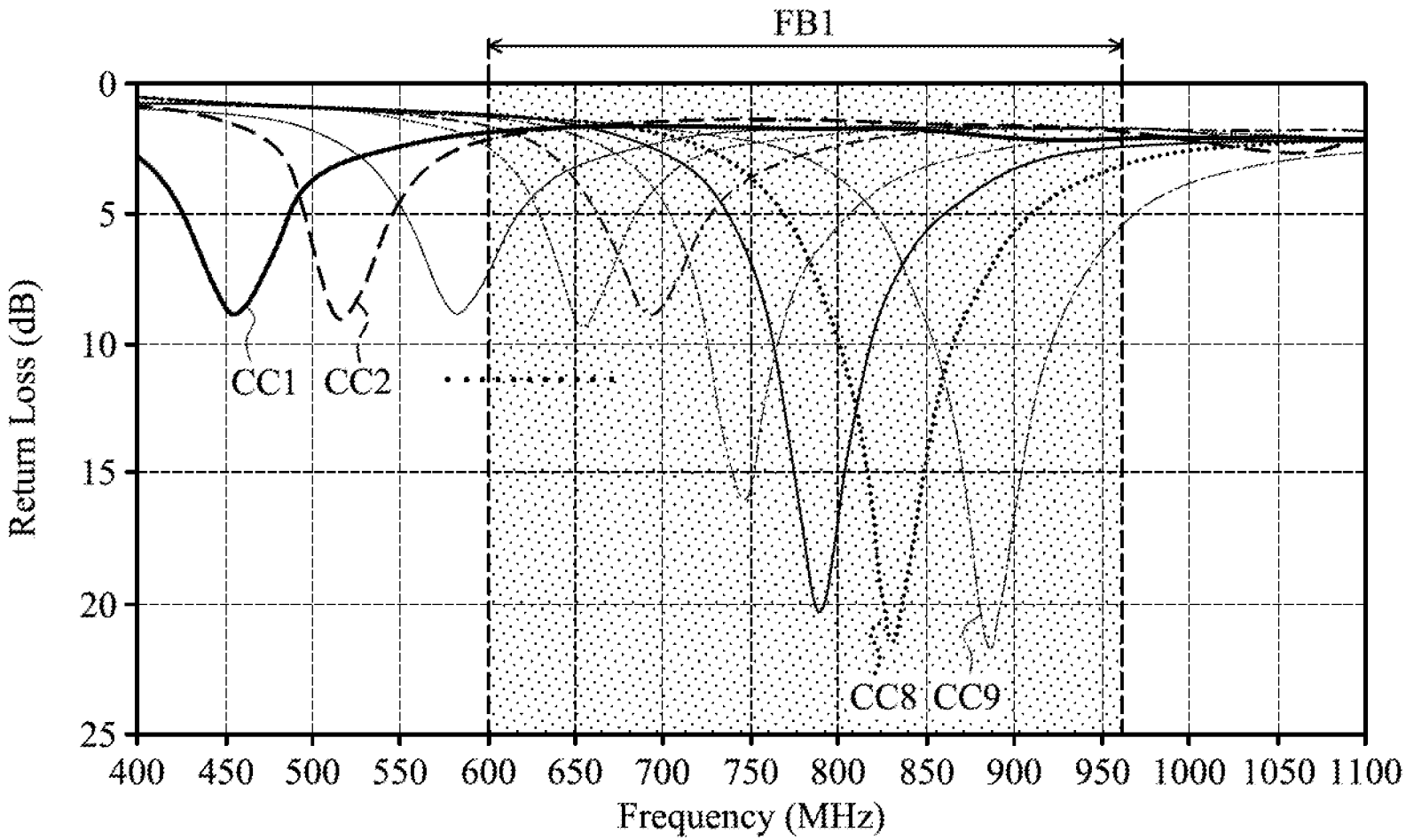
FIG. 3 is a diagram of return loss of an antenna structure according to an embodiment of the invention.

FIG. 3 is a diagram of return loss of the antenna structure 100 (or 200) according to an embodiment of the invention. The horizontal axis represents the operational frequency (MHz), and the vertical axis represents the return loss (dB). As shown in FIG. 3, a first curve CC1, a second curve CC2, . . . , an eighth curve CC8, and a ninth curve CC9 correspond to a variety of impedance values provided by the first tuner 230 and the second tuner 260. For example, the operational characteristics of the antenna structure 100 (or 200) may be described by the first curve CC1 if the first switch element 235 and the second switch element 265 are both closed and the first variable capacitor C1 and the second variable capacitor C2 provide their largest capacitances. The operational characteristics of the antenna structure 100 (or 200) may be described by the eighth curve CC8 if the first switch element 235 and the second switch element 265 are both closed and the first variable capacitor C1 and the second variable capacitor C2 provide their smallest capacitances. In addition, the operational characteristics of the antenna structure 100 (or 200) may be described by the ninth curve CC9 if the first switch element 235 and the second switch element 265 are both opened. According to the measurement of FIG. 3, the antenna structure 100 (or 200) can cover at least a first frequency band FB1. The first frequency band FB1 may be from 600 MHz to 960 MHz. However, the invention is not limited thereto. In alternative embodiments, the first frequency band FB1 is from 400 MHz to 960 MHz, so as to include a relatively low frequency interval.

In some embodiments, the operational principles of the antenna structure 100 (or 200) will be described as follows. The second radiation element 150 is excited by the feeding radiation element 110 and the first radiation element 120 using a coupling mechanism, so as to form the first frequency band FB1. The shorting element 140 is configured to fine-tune the impedance matching of the first frequency band FB1. Furthermore, the first tuner 130 and the second tuner 160 are configured to significantly increase the operational bandwidth of the antenna structure 100.

In some embodiments, the element sizes of the antenna structure 100 (or 200) will be described as follows. The total length L1 of the feeding radiation element 110 and the first radiation element 120 may be from 0.25 to 0.5 wavelength ($\lambda/4 \sim \lambda/2$) of the first frequency band FB1 of the antenna structure 100. The width W1 of the first radiation element 120 may be from 1 mm to 5 mm. The length L2 of the second radiation element 150 may be from 0.125 to 0.25 wavelength ($\lambda/8 \sim \lambda 4$) of the first frequency band FB1 of the antenna structure 100. The width W2 of the second radiation element 150 may be from 1 mm to 5 mm. The path length L3 between the feeding point FP and the first connection point CP1 may be from 0.125 to 0.25 wavelength ($\lambda/8 \sim \lambda/4$) of the first frequency band FB1 of the antenna structure 100. The width W3 of the shorting element 140 may be from 1 mm to 5 mm. The width of the coupling gap GC1 may be from 0.5 mm to 2 mm. The capacitance of the first capacitor C1 may be from 0.7 pF to 8 pF. The capacitance of the second capacitor C2 may be from 0.7 pF to 8 pF. The above ranges of element sizes are calculated and obtained according to many experiment results, and they help to optimize the operational bandwidth and impedance matching of the antenna structure 100 (or 200).

The following embodiments will introduce other configurations of the antenna structure 100, which can provide similar performance. It should be understood that these figures and descriptions are merely exemplary, rather than limitations of the invention.

Figure 4:
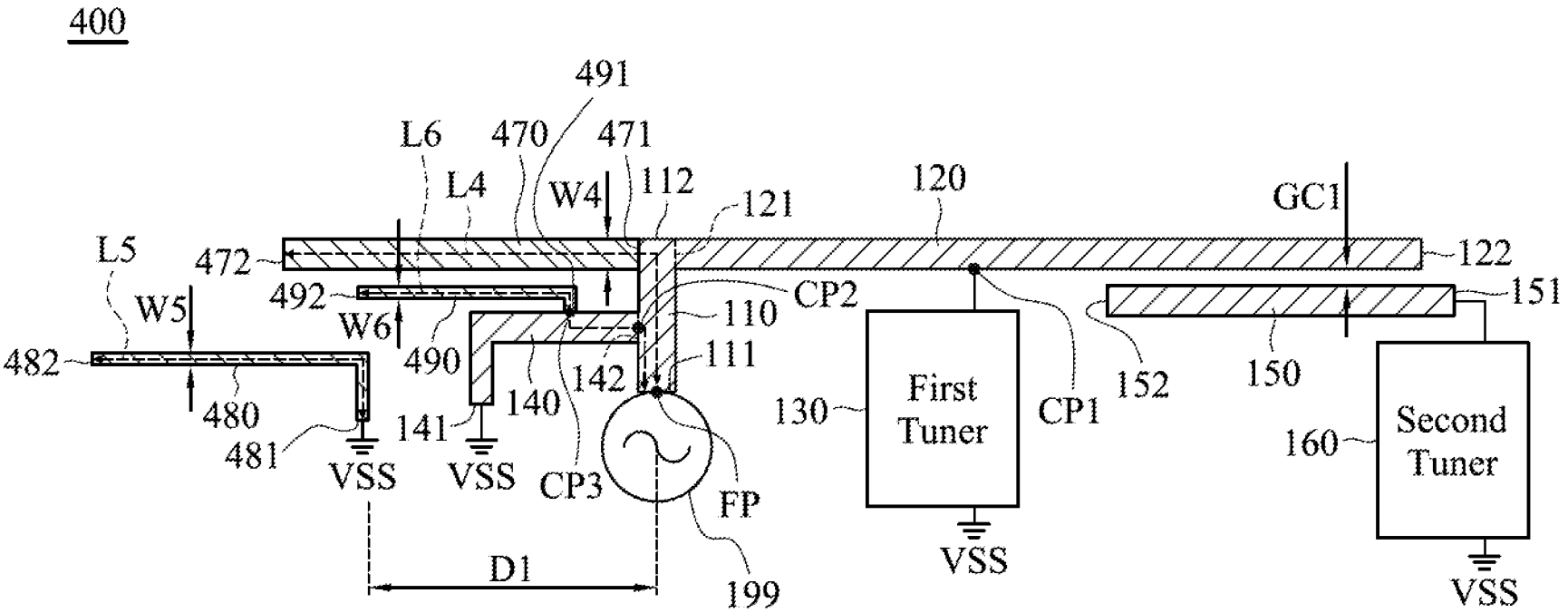
FIG. 4 is a diagram of an antenna structure according to an embodiment of the invention.

FIG. 4 is a diagram of an antenna structure 400 according to an embodiment of the invention. FIG. 4 is similar to FIG. 1. In the embodiment of FIG. 4, the antenna structure 400 further includes a third radiation element 470, a fourth radiation element 480, and a fifth radiation element 490, which may all be made of metal materials.

The third radiation element 470 may substantially have a straight-line shape, which may be substantially perpendicular to the feeding radiation element 110. Specifically, the third radiation element 470 has a first end 471 and a second end 472. The first end 471 of the third radiation element 470 is coupled to the second end 112 of the feeding radiation element 110. The second end 472 of the third radiation element 470 is an open end. For example, the second end 472 of the third radiation element 470 and the second end 122 of the first radiation element 120 may substantially extend in opposite directions and away from each other. In some embodiments, the combination of the feeding radiation element 110, the first radiation element 120, and the third radiation element 470 substantially has a T-shape.

The fourth radiation element 480 may substantially have a relatively thin L-shape. The fourth radiation element 480 is adjacent to the feeding point FP. Specifically, the fourth radiation element 480 has a first end 481 and a second end 482. The first end 481 of the fourth radiation element 480 is coupled to the ground voltage VSS. The second end 482 of the fourth radiation element 480 is an open end. For example, the second end 482 of the fourth radiation element 480 and the second end 472 of the third radiation element 470 may substantially extend in the same direction.

The fifth radiation element 490 may substantially have another relatively thin L-shape. The fifth radiation element 490 is disposed between the third radiation element 470 and the shorting element 140. Specifically, the fifth radiation element 490 has a first end 491 and a second end 492. The first end 491 of the fifth radiation element 490 is coupled to a third connection point CP3 on the shorting element 140. The second end 492 of the fifth radiation element 490 is an open end. For example, the second end 492 of the fifth radiation element 490 and the second end 472 of the third radiation element 470 may substantially extend in the same direction. Other features of the antenna structure 400 of FIG. 4 are similar to those of the antenna structure 100 of FIG. 1. Accordingly, the two embodiments can achieve similar levels of performance.

Figure 5:
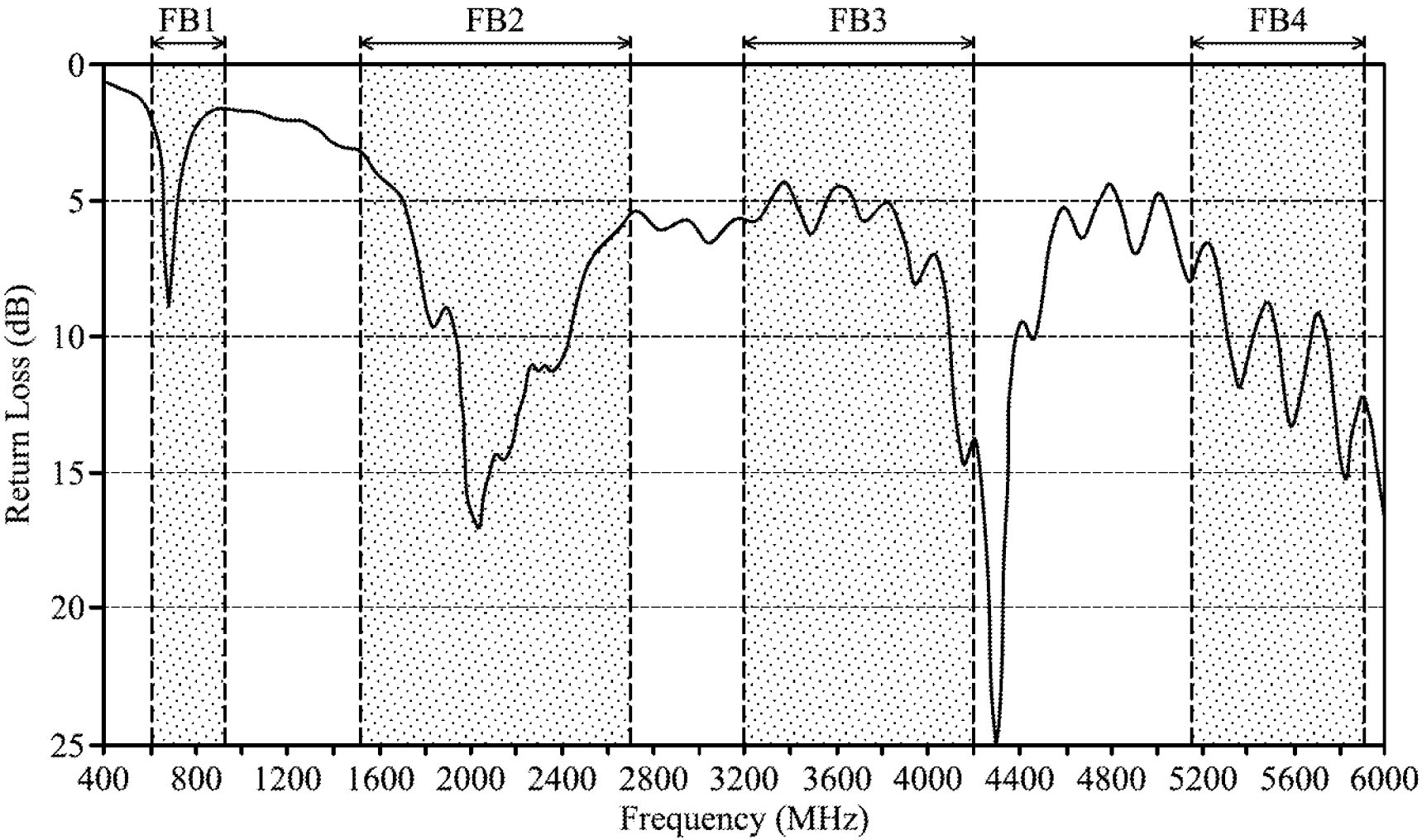
FIG. 5 is a diagram of return loss of an antenna structure according to an embodiment of the invention.

FIG. 5 is a diagram of return loss of the antenna structure 400 according to an embodiment of the invention. The horizontal axis represents the operational frequency (MHz), and the vertical axis represents the return loss (dB). According to the measurement of FIG. 5, the antenna structure 400 can further cover a second frequency band FB2, a third frequency band FB3, and a fourth frequency band FB4. For example, the second frequency band FB2 may be from 1575 MHz to 2690 MHz, the third frequency band FB3 may be from 3200 MHz to 4200 MHz, and the fourth frequency band FB4 may be from 5150 MHz to 5925 MHz. Accordingly, the antenna structure 400 can support at least the wideband operations of sub-6 GHz of the next-generation 5G communication.

In some embodiments, the operational principles of the antenna structure 400 will be described as follows. The feeding radiation element 110 and the third radiation element 470 are excited to generate the second frequency band FB2. The fourth radiation element 480 is excited to generate the third frequency band FB3. The feeding radiation element 110, the shorting element 140, and the fifth radiation element 490 are excited to generate the fourth frequency band FB4. In other words, the incorporation of the third radiation element 470, the fourth radiation element 480, and the fifth radiation element 490 can help to increase the high-frequency operational bandwidth of the antenna structure 400.

In some embodiments, the element sizes of the antenna structure 400 will be described as follows. The total length L4 of the feeding radiation element 110 and the third radiation element 470 may be from 0.25 to 0.5 wavelength ($\lambda/4\sim\lambda/2$) of the second frequency band FB2 of the antenna structure 400. The width W4 of the third radiation element 470 may be from 1 mm to 5 mm. The length L5 of the fourth radiation element 480 may be from 0.5 to 1 wavelength ($\lambda/2\sim1\lambda$) of the third frequency band FB3 of the antenna structure 400. The width W5 of the fourth radiation element 480 may be from 1 mm to 4 mm. The distance D1 between the fourth radiation element 480 and the feeding point FP may be from 0.125 to 0.25 wavelength ($\lambda/8\sim\lambda/4$) of the third frequency band FB3 of the antenna structure 400. The path length L6 from the feeding point FP through the second connection point CP2 and the third connection point CP3 to the second end 492 of the fifth radiation element 490 may be from 0.25 to 0.5 wavelength ($\lambda/4\sim\lambda/2$) of the fourth frequency band FB4 of the antenna structure 400. The width W6 of the fifth radiation element 490 may be from 1 mm to 4 mm. The above ranges of element sizes are calculated and obtained according to many experiment results, and they help to optimize the operational bandwidth and impedance matching of the antenna structure 400.

The invention proposes a novel antenna structure, which includes two tuners. In comparison to the conventional design, the invention has at least the advantages of tunable impedance values, small size, wide bandwidth, and low manufacturing cost. Therefore, the invention is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-5. The invention may merely include any one or more features of any one or more embodiments of FIGS. 1-5. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a feeding radiation element, having a feeding point;

a first radiation element, coupled to the feeding radiation element;

a first tuner, wherein the first radiation element is coupled through the first tuner to a ground voltage;

a shorting element, wherein the feeding radiation element is coupled through the shorting element to the ground voltage;

a second radiation element, disposed adjacent to the first radiation element, and separated from the first radiation element; and a second tuner, wherein the second radiation element is coupled through the second tuner to the ground voltage;

wherein the feeding radiation element is disposed between the first tuner and the shorting element;

wherein the antenna structure covers a first frequency band;

wherein a total length of the feeding radiation element and the first radiation element is from 0.25 to 0.5 wavelength of the first frequency band;

wherein the first frequency band is from 600 MHz to 960 MHz, and wherein the first tuner is coupled to a first connection point on the first radiation element, and a path length between the feeding point and the first connection point is from 0.125 to 0.25 wavelength of the first frequency band.

2. The antenna structure as claimed in claim 1, wherein the feeding radiation element substantially has a relatively short straight-line shape, the first radiation element substantially has a relatively long straight-line shape, and the first radiation element is substantially perpendicular to the feeding radiation element.

3. The antenna structure as claimed in claim 1, wherein the shorting element substantially has an L-shape.

4. The antenna structure as claimed in claim 1, wherein the second radiation element substantially has a straight-line shape.

5. The antenna structure as claimed in claim 1, wherein a coupling gap is formed between the second radiation element and the first radiation element, and a width of the coupling gap is from 0.5 mm to 2 mm.

6. The antenna structure as claimed in claim 1, wherein a length of the second radiation element is from 0.125 to 0.25 wavelength of the first frequency band.

7. The antenna structure as claimed in claim 1, wherein the first tuner comprises a first variable capacitor and a first switch element coupled in series.

8. The antenna structure as claimed in claim 7, wherein a capacitance of the first variable capacitor is from 0.7 pF to 8 pF, and the first switch element is selectively closed or opened.

9. The antenna structure as claimed in claim 1, wherein the second tuner comprises a second variable capacitor and a second switch element coupled in series.

10. The antenna structure as claimed in claim 9, wherein a capacitance of the second variable capacitor is from 0.7 pF to 8 pF, and the second switch element is selectively closed or opened.

11. The antenna structure as claimed in claim 1, further comprising:

a third radiation element, coupled to the feeding radiation element, wherein the third radiation element and the first radiation element substantially extend in opposite directions.

12. The antenna structure as claimed in claim 11, further comprising:

a fourth radiation element, coupled to the ground voltage, wherein the fourth radiation element is adjacent to the feeding point.

13. The antenna structure as claimed in claim 12, further comprising:

a fifth radiation element, coupled to the shorting element, wherein the fifth radiation element is disposed between the third radiation element and the shorting element.

14. The antenna structure as claimed in claim 13, wherein the antenna structure further covers a second frequency band, a third frequency band, and a fourth frequency band, the second frequency band is from 1575 MHz to 2690 MHz, the third frequency band is from 3200 MHz to 4200 MHz, and the fourth frequency band is from 5150 MHz to 5925 MHz.

15. The antenna structure as claimed in claim 14, wherein a total length of the feeding radiation element and the third radiation element is from 0.25 to 0.5 wavelength of the second frequency band.

16. The antenna structure as claimed in claim 14, wherein a length of the fourth radiation element is from 0.5 to 1 wavelength of the third frequency band.

17. The antenna structure as claimed in claim 14, wherein a distance between the fourth radiation element and the feeding point is from 0.125 to 0.25 wavelength of the third frequency band.

* * * * *